US006772830B1

(12) United States Patent
Larsen et al.

(10) Patent No.: US 6,772,830 B1
(45) Date of Patent: Aug. 10, 2004

(54) ENHANCED CROSSFLOW HEAT TRANSFER

(75) Inventors: Thomas L. Larsen, Andover, MA (US); Umesh K. Jayaswal, Lexington, MA (US)

(73) Assignee: Stone & Webster, Inc., Houston, TX (US)

( * ) Notice: Subject to any disclaimer, the term of this patent is extended or adjusted under 35 U.S.C. 154(b) by 79 days.

(21) Appl. No.: 10/048,129

(22) PCT Filed: Jul. 18, 2000

(86) PCT No.: PCT/US00/40401

§ 371 (c)(1),
(2), (4) Date: Apr. 5, 2002

(87) PCT Pub. No.: WO01/07857

PCT Pub. Date: Feb. 1, 2001

Related U.S. Application Data

(60) Provisional application No. 60/144,948, filed on Jul. 21, 1999.

(51) Int. Cl.[7] ..... F28D 1/04

(52) U.S. Cl. ..... 165/151; 165/148; 165/160; 165/161; 165/172; 165/181

(58) Field of Search ..... 165/161, 160, 165/181, 172

(56) References Cited

U.S. PATENT DOCUMENTS

| | | | | | |
|---|---|---|---|---|---|
| 3,616,849 | A | | 11/1971 | Dijt | 165/159 |
| 3,630,276 | A | * | 12/1971 | Paine et al. | 165/158 |
| 3,916,990 | A | * | 11/1975 | Ruhe et al. | 165/158 |
| 4,434,846 | A | * | 3/1984 | Lu | 165/161 |
| 4,594,227 | A | | 6/1986 | Ohsaki et al. | 422/148 |
| 4,848,449 | A | * | 7/1989 | Brucher et al. | 165/160 |
| 5,109,919 | A | | 5/1992 | Sakuma et al. | 165/151 |
| 5,690,169 | A | * | 11/1997 | Foerster | 165/160 |
| 5,755,280 | A | * | 5/1998 | da Costa et al. | 165/140 |
| 5,915,472 | A | * | 6/1999 | Takikawa et al. | 165/158 |

* cited by examiner

*Primary Examiner*—Henry Bennett
*Assistant Examiner*—Nihir Patel
(74) *Attorney, Agent, or Firm*—Hedman & Costigan, P.C.

(57) ABSTRACT

Baffles (20, 22) arranged alongside a plurality of conduits (12).

42 Claims, 8 Drawing Sheets

ENHANCED CROSSFLOW HEAT TRANSFER

This application claims the benefit of provisional application No. 60/144,948, filed Jul. 21, 1999.

The present invention relates generally to methods and related apparatus for enhancing heat transfer to or from a fluid flowing cross-wise in contact with the outer thermally-conductive shells of a plurality of axially-oriented heat exchange conduits capable of acting as heat sources or heat sinks. By channeling cross-wise fluid flow, flowing generally orthogonal to the axes of the heat exchange conduits and contouring it upstream, downstream and/or around or alongside the heat exchange conduits utilizing slotted or apertured plates, baffles or surrounding sleeve-like elements, a surprisingly more effective and efficient heat transfer between the flowing fluid and the thermally-conductive surface is realized.

BACKGROUND OF THE INVENTION

It is well known to heat or cool process fluids, which may be liquids or gases, by flowing them into contact with a thermal-transfer surface that is maintained at a temperature which is different from that of the upstream process fluid thereby resulting in heat transfer either to or from the process fluid (depending on whether the thermal-transfer surface is maintained at a higher or lower temperature than the fluid). In one familiar version of this technology, the thermal-transfer surface that acts as a heat source or heat sink is the exterior of a thermally-conductive shell of a thermal-transfer tube or pipe, for example, which is heated or cooled by means of a liquid flowing axially through the interior of the tube or pipe. In a variation of this technology, heat may be supplied directly inside a heat exchange conduit by means of flameless combustion of fuel gas (such as hydrogen or a hydrocarbon) as taught, for example, by U.S. Pat. Nos. 5,255,742 and 5,404,952, which are incorporated herein by reference.

It is also known in the art to flow a process fluid axially along a thermal-transfer surface, either concurrently or counter-currently relative to the direction of liquid flow inside the thermal-transfer tube, or to crossflow the process fluid relative to the axis of the thermal-transfer tube, or some combination of the two. Typical applications of heat transfer between crossflowing fluid and heat exchanging conduits are found in air coolers, economizers associated with fired heaters or furnaces, and in shell and tube exchangers. Various types of so-called radial or axial/radial flow reactor designs are known for various applications whereby at least a part of a fluid process stream moves, at some point, through the reactor in a radial, crossflow direction (i.e., inward-to-out or outward-to-in), as contrasted with the more familiar axial flow (i.e., end-to-end) reactor designs. Examples of reactor designs embodying at least in part a radial, crossflow of process fluid relative to a plurality of axially-disposed heat-transfer tubes are shown in U.S. Pat. Nos. 4,230,669; 4,321,234; 4,594,227; 4,714,592; 4,909,808; 5,250,270; and 5,585,074, each of which is incorporated herein by reference.

Although crossflow contact of a process fluid with a heat-transfer surface can be an attractive option for many applications, the utility of crossflow contact for industrial applications has been limited by certain heat transfer inefficiencies which have been experienced in practice. Typically in crossflow designs, a given portion of the process fluid is in contact with the heat-transfer surface for a shorter time than with a comparable axial flow design. In addition, the contact between the crossflowing process fluid and the heat-transfer surface is uneven due to process fluid separation and recirculation. Short surface contact time, uneven contact, and limited fluid mixing can lead to inefficient, insufficient, and/or non-uniform thermal energy transfer.

Thus, in an article entitled "Impingement heat transfer at a circular cylinder due to an offset of non-offset slot jet," appearing in Int. J. Heat Mass Transfer., vol. 27, no. 12, pp. 2297–2306(1984), the authors Sparrow and Alhomoud report experimental efforts to vary the heat transfer coefficients associated with crossflow of a process gas relative to a heat-transfer tube by positioning a slotted surface some distance upstream of the heat-transfer tube to create a gas jet. Sparrow and Alhomoud varied the width of the jet-inducing slot, the distance between the slot and the tube, the Reynolds number (degree of fluid turbulence), and whether the slot jet was aligned with or offset from the tube. The authors concluded that the heat transfer coefficient increased with slot width and Reynolds number, but decreased with slot-to-tube separation distance and offset.

Because the Sparrow and Alhomoud study concluded that the heat transfer coefficient increased with slot width, the general utility of an upstream slot to increase heat transfer is at best ambiguous based on these results. It can only be concluded that, in the experimental design used by Sparrow and Alhomoud, a relatively wider slot led to a higher heat transfer coefficient than a relatively narrower slot, and no upstream slot at all might yield the highest value. No testing was performed utilizing a plurality of heat-transfer tubes, or using upstream and downstream pairs, or around or alongside flow constriction means to preferentially contour crossflow fluid paths in contact with the outer surface of each of a plurality of heat-transfer tubes, and no reasonable extrapolations can be made to such very different alternative designs and configurations based on the extremely limited data presented.

These and other drawbacks with and limitations of the prior art crossflow heat exchanged designs are overcome in whole or in part with the enhanced crossflow heat transfer methods and designs of this invention.

OBJECTS OF THE INVENTION

Accordingly, a principal object of this invention is to provide methods and designs for enhanced crossflow heat transfer between a process fluid and a heat-transfer surface.

It is a general object of this invention to provide methods and designs for specially directing and shaping fluid crossflow paths in contact with one or more heat-transfer surfaces so as to enhance heat transfer between the fluid and the heat-transfer surfaces.

A specific object of this invention is to provide fluid flow-constriction means upstream, downstream and/or around or alongside a heat-transfer surface so as to preferentially contour a process fluid stream flowing cross-wise past the heat-transfer surface to enhance heat transfer between the fluid stream and the heat-transfer surface.

A further specific object of this invention is to provide curved or flat apertured plates or apertured sleeves disposed relative to each conduit in an array of heat exchange conduits so as to preferentially contour the flow path of the fluid stream flowing cross-wise past the outside of each of the conduits to realize improved heat transfer.

Still another object of this invention is to provide heat-transfer conduit arrays of varying sizes and configurations wherein each conduit of the array is associated with its own fluid flow-constriction means upstream, downstream and/or around or alongside of the conduit so as to preferentially contour the portion of the fluid stream flowing cross-wise past the outside of the conduit to realize improved heat transfer.

Other objects and advantages of the present invention will in part be obvious and will in part appear hereinafter. The invention accordingly comprises, but is not limited to, the methods and related apparatus, involving the several steps and the various components, and the relation and order of one or more such steps and components with respect to each of the others, as exemplified by the following description and the accompanying drawings. Various modifications of and variations on the method and apparatus as herein described will be apparent to those skilled in the art, and all such modifications and variations are considered within the scope of the invention.

SUMMARY OF THE INVENTION

In the present invention, a baffle structure comprising at least a paired set of fluid flow constructors is utilized to preferentially contour the flow path of a process fluid flowing cross-wise, or substantially cross-wise, in contact with a heat-transfer surface in order to enhance heat transfer between the fluid and the surface. The apparatus is designed so as to substantially restrict the bypassing of fluid flow such that a predominant portion of the process fluid is forced to flow past the heat-transfer surface. The heat-transfer surface will typically be one or a configured array of heat exchange conduits, oriented to have parallel axes disposed in an axial direction which is generally orthogonal to the direction of fluid flow, and having a thermally-conductive shell. The exterior surface of the shell of each such conduit is maintained at a temperature different from that of the upstream process fluid so that thermal energy is transferred to or from the process fluid by means of conduction, convection, radiation or some combination thereof, as the fluid flows past and contacts the exterior surfaces of the heat exchange conduits.

The heat exchange conduits or ducts of this invention may broadly comprise tubes, pipes, or any other enclosures with heat sources or heat sinks. The exterior surfaces of the heat exchange conduits may be bare or, as discussed below, may be finned or any combination of the two. The cross-section of the conduits or ducts may be circular, elliptical, or any other closed shapes. Where a plurality of such heat exchange conduits are used, they will typically be arrayed in some predetermined configuration such as in a triangular array, a square array, a circular array, an annular array, or other such patterns depending on design choice and/or the requirements of a particular application. Relative to the direction of fluid flow, adjacent conduits may be aligned, staggered or otherwise positioned, again depending on design choice and/or application requirements.

The size of the heat exchange conduits will be dictated, at least in part, by process requirements for the rate of heat transfer. In general, conduits having larger cross-sections (for any given conduit geometry) will provide larger surface areas and therefore more heat transfer capacity. Fin elements, baffles or other heat-transfer enhancing structures may be provided on the outside surface of some or all of the heat exchange conduits to further increase surface area and improve heat transfer characteristics. A preferred embodiment utilizes closely spaced circumferential fins applied in a spiral along the exterior length of the conduit. This arrangement increases the heat-transfer surface area exposed to the crossflow without impeding the flow. It will be understood that the nature and flowrate of the process fluid, and the desired temperature change in the fluid between upstream of the heat exchange conduits and downstream of the conduits, will also affect these design choices.

The fluid flow constriction means for contouring the cross-wise flow of the process fluid may comprise inlets, outlets and openings of various shapes and sizes in baffle structures located upstream, downstream and/or around or alongside the heat exchange conduits. In a further preferred embodiment, each heat exchange conduit has its own associated pair of upstream and downstream fluid flow constrictors or its own around or alongside flow constrictors as described below. The apertured baffle structures which function as fluid flow constriction means may comprise plates, sleeves or other baffles which comprise substantially flat surfaces, or curved surfaces, or a combination of flat and curved surfaces. Apertured structures of this type positioned in pairs upstream and downstream of an array of heat exchange conduits have been found to enhance heat transfer by a factor of about one and one-half to about two times. In a particularly advantageous embodiment for certain applications, the fluid flow constriction structure is a larger, generally concentric sleeve-like structure at least partially surrounding each conduit in an array of tubular heat exchange conduits, each such sleeve structure having apertures upstream and downstream of the centrally-located heat exchange tube. Apertured sleeves of this type at least partially surrounding individual heat exchange conduits in an array of such conduits have been found to enhance heat transfer by a factor of about five times or more.

The apertures in the fluid flow constriction structure preferably comprise any combination of perforated holes or axial slots (i.e., elongated apertures having a longer axis generally parallel to the axial orientation of the heat exchange conduits). The holes or slots in different portions of the apparatus may be the same or differ in curvature, size and shape. The edges around the inlets and outlets may be straight, rounded, jagged, or some combination thereof.

The fluid flow constriction structure is preferably positioned relative to an associated heat exchange conduit such that the distance between the centerline of an upstream or downstream aperture and the associated heat exchange conduit centroid ranges from about 0 to about 2.0, preferably from about 0.50 to about 1.00, times the outer diameter (or largest cross-sectional dimension of a non-circular conduit) of the conduit. In any case, the spacing between aperture and conduit must be sufficiently close to realize substantially enhanced heat transfer. The width (shortest side) of an elongated flow constriction aperture or the diameter of a generally circular hole constriction aperture may preferably range from about 0.02 to about 1.5, preferably from about 0.05 to about 0.25, times the outside diameter (or largest cross-sectional dimension of a non-circular conduit) of the conduit. The fluid flow constriction structure is preferably positioned relative to an associated heat exchange conduit such that the offset between the center of the aperture and the centroid of the heat exchange conduit ranges from 0 to 0.5, preferably 0, times the outside diameter (or largest cross-sectional dimension of a non-circular conduit) of the conduit.

The enhanced crossflow heat exchange apparatus of this invention enhances heat transfer between the crossflowing fluid and the plurality of heat exchange conduits by one or more of the following mechanisms: (a) increasing the fluid velocity around the heat exchange conduits; (b) preferentially directing the fluid to closely follow the outer surface of the heat exchange conduits; (c) restricting the fluid from flowing into or through areas that are distant from the outer surface of a heat exchange conduit; (d) reducing "dead" regions and flow recirculation around heat exchange conduits; (e) enhancing fluid turbulence; and (f) enhancing mixing between colder and hotter portions of the fluid.

DETAILED DESCRIPTION OF THE PREFERRED EMBODIMENTS

Figure 1:
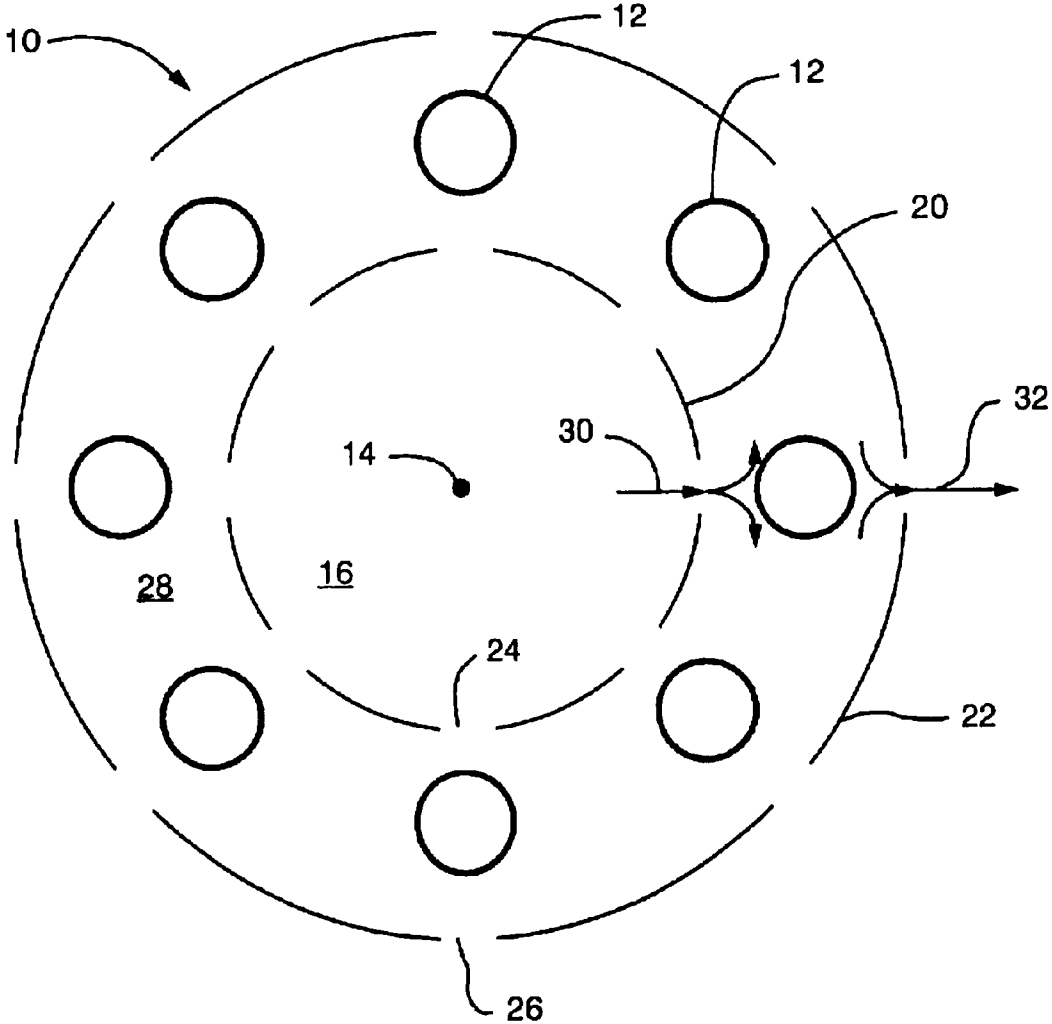
FIG. 1 is a schematic top sectional view of a first embodiment of a crossflow heat exchange apparatus, with heat transfer enhancement according to the present invention, wherein a substantially circular array of axially-disposed heat exchange conduits is positioned inside a fluid flow-constricted annulus.

FIG. 1 shows a crossflow heat exchange apparatus 10 according to this invention having a generally circular array of axially-disposed heat exchange conduits 12 distributed around the interior of an annular region 28 defined by an inner cylindrical wall 20 and an outer cylindrical wall 22, each having a common centerpoint 14. As shown in FIG. 1, conduits 12 are of substantially the same diameter, which is less than the radial width of the annular region, and spaced substantially equidistant from one another.

Associated with each heat exchange conduit 12 is an upstream aperture 24 in inner wall 20 and a downstream aperture 26 in outer wall 22. As shown in FIG. 1, respective pairs of upstream apertures 24 and downstream apertures 26 are substantially in radial alignment with the associated conduit 12 and with each other. Thus, in FIG. 1, a process fluid 30 is flowed axially into the inner cylindrical region 16 of the heat exchange apparatus 10 and then directed radially outward through upstream apertures 24, flowing cross-wise into contact with the heat exchange conduits 12, as denoted by the fluid flow arrows in FIG. 1, thereby heating or cooling the process stream to form a thermally-conditioned fluid stream 32 which exits annular region 28 through downstream apertures 26.

It will be understood that whereas FIG. 1 illustrates a radially-outward fluid flow path, the same apparatus could be utilized for thermally treating a process stream flowing radially inward to center region 16 and thereafter being axially withdrawn from region 16. In this variation, apertures 26 in the outer wall 22 would be the upstream apertures and apertures 24 in inner wall 20 would be the downstream apertures.

Figure 2A:
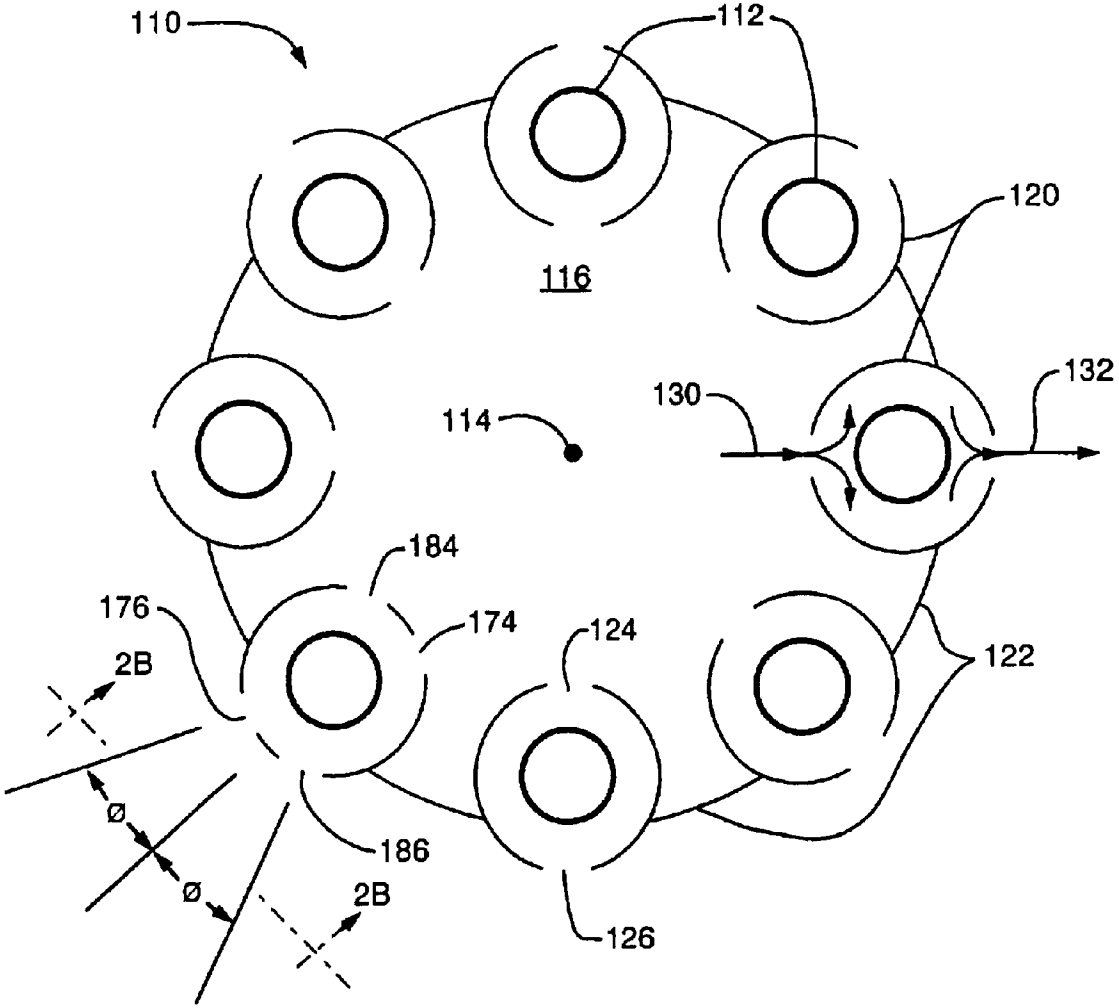
FIG. 2A is a schematic plan view of a second embodiment of a crossflow heat exchange apparatus, with heat transfer enhancement according to the present invention, showing a substantially circular array of axially-disposed heat exchange conduits, each surrounded by a substantially concentric, fluid flow-constricted tubular sleeve, and also showing the several fluid flow-constricted sleeves joined together in a first ring-like structure.
Figure 2B:
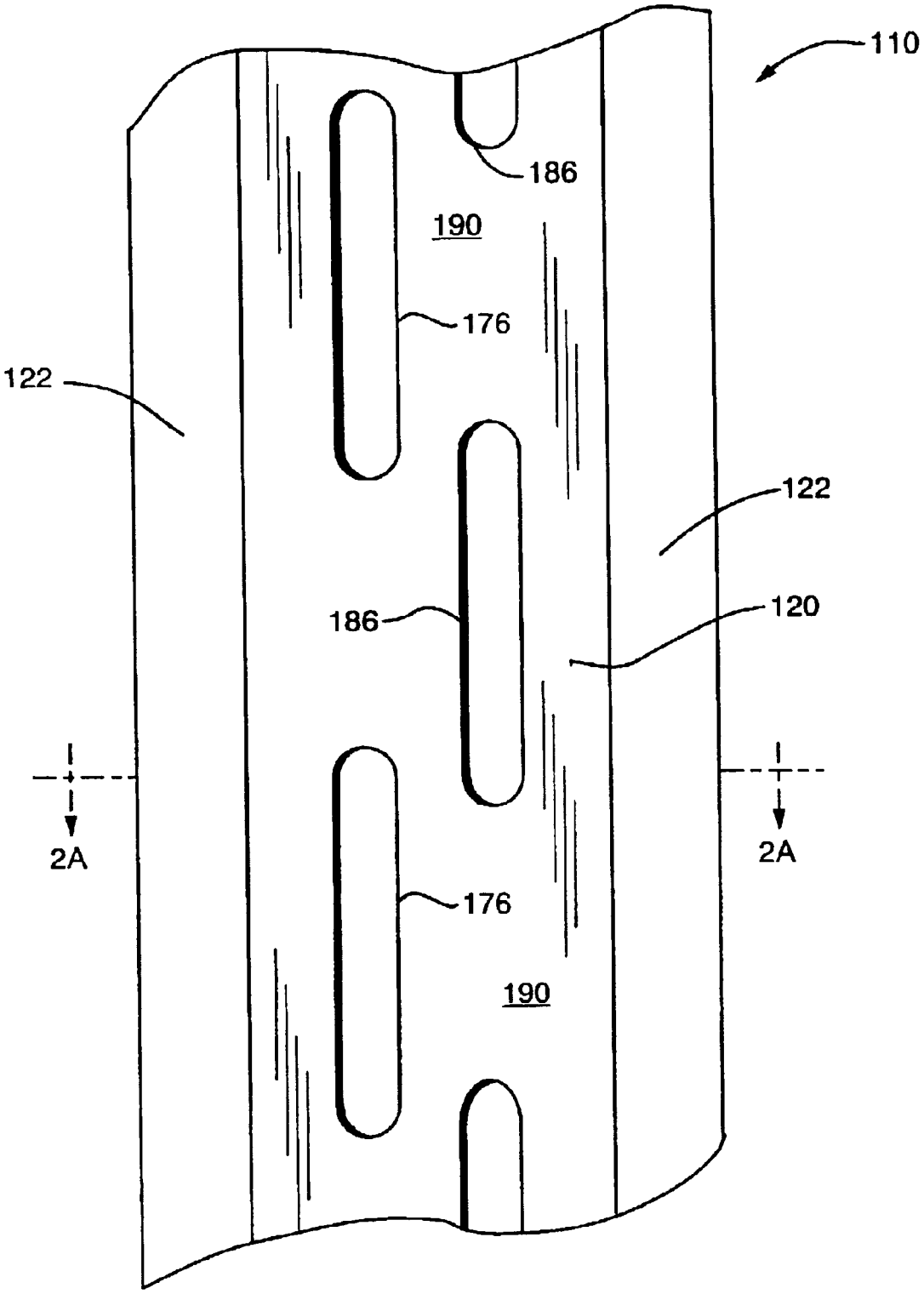
FIG. 2B is a side view of one conduit-sleeve combination illustrating a preferred staggered offset slot configuration.

FIGS. 2A and 2B show a particularly preferred crossflow heat exchange apparatus 110 according to this invention having a generally circular array of axially-disposed heat exchange conduits 112, each surrounded by an apertured sleeve 120 having either an upstream aperture 124 and a downstream aperture 126 or offset aperture pairs 174, 176 and 184, 186 as described below. The individual sleeves 120 are joined together into a larger ring-like or cylindrical structure by connecting walls 122. Apertures 124 and 126 may comprise columns of axially-oriented perforation holes or elongated slots which are radially aligned with the conduits 112. Alternatively, in a preferred embodiment also illustrated in one portion of FIG. 2A, aperture pairs 174, 176 and 184, 186 are slightly offset from radial alignment in a staggered slot arrangement. The staggered slot arrangement for aperture pairs 174, 176 and 184, 186 is illustrated in FIG. 2A, with additional detail in FIG. 2B, where offset slot pairs 174, 176 and 184, 186 (replacing apertures pairs 124, 126) are staggered in elevation and offset slightly from the radial line from centerpoint 114 by equal angles θ. FIG. 2B shows a side view taken along the line 2B—2B in FIG. 2A of a heat exchange conduit 112 having a cylindrical sleeve 120 with the preferred staggered slot arrangement. The plan view of this staggered slot conduit/sleeve combination as shown in FIG. 2A is taken along the line 2A—2A in FIG. 2B. The ends of the slots from alternating offset slot pairs can be slightly overlapped or at equal elevation so there is no interruption of flow along the axial direction of the heat exchange apparatus. This design with separation and overlap of the offset slots also leaves connection regions between the axially overlapped portions of adjacent offset slots, indicated generally by the reference numeral 190 in FIG. 2B, to provide the sleeves 120 with better circumferential mechanical integrity without blocking any fluid flow. For simplified illustration, FIG. 2A shows one apertured sleeve 120 having the two-pair offset aperture configuration while the other sleeves have the one-pair aligned aperture configuration. In practice, however, all of the apertured sleeves for a particular apparatus 110 will typically have the same aperture configuration.

Thus, in FIG. 2A, a process fluid 130 is flowed axially into the inner cylindrical region 116 having centerpoint 114 of the heat exchange apparatus 110 and then directed radially outward through upstream apertures 124, flowing cross-wise into contact with the heat exchange conduits 112, as denoted by the fluid flow arrows in FIG. 2A, thereby heating or cooling the process stream to form a thermally-conditioned fluid stream 132 which exits the interior regions defined by the sleeves 120 through downstream apertures 126. In the staggered slot embodiment, fluid flowing radially outward would either flow through upstream aperture 174, into contact with conduit 112, and exit through downstream aperture 176, or, depending on the axial elevation, instead flow through aperture pair 184, 186. It will be understood that whereas FIG. 2A illustrates a radially-outward fluid flow path, the same apparatus could be utilized for thermally treating a process stream flowing radially inward to center region 116 and thereafter being axially withdrawn from region 116. In this variation, apertures 126 (or 176 and 186) would be the upstream apertures, and apertures 124 (or 174 and 184) would be the downstream apertures.

Figure 3:
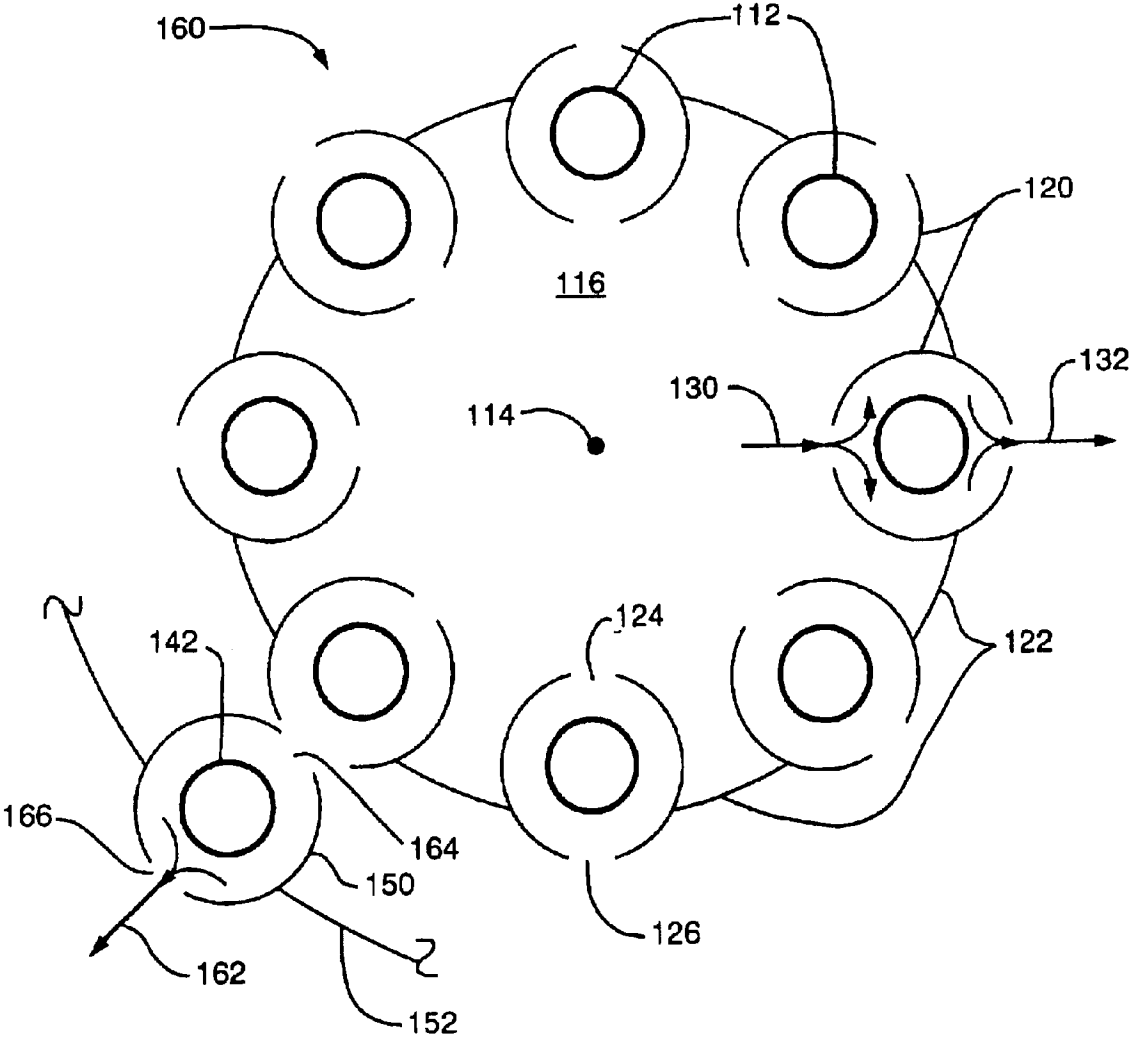
FIG. 3 illustrates a variation of the structure of FIG. 2 showing a double, concentric circular array of heat exchange conduits with radially adjacent conduits shown in alignment such that the fluid flow-restriction apertures of the respective flow-restricted sleeves associated with these radially aligned conduits are also in radial alignment.

FIG. 3 shows a crossflow heat exchange apparatus 160 which is a variation of the crossflow heat exchange apparatus 110 shown in FIG. 2. Apparatus 160 differs from apparatus 110 in the use of a double, concentric circular array of heat exchange conduits instead of the single circular array of FIG. 2. As seen in FIG. 3, there is a second circular array of heat exchange conduits 142, each in radial alignment with a corresponding conduit 112 of the first circular array. Each conduit 142 is surrounded by an apertured sleeve 150 having an upstream aperture 164 and a downstream aperture 166. Apertures 164 and 166 for a given sleeve 150 associated with a particular conduit 142 are shown substantially in radial alignment with the apertures 124 and 126 in the sleeve 120 of the corresponding radially adjacent conduit 112. The individual sleeves 150 are joined together into a larger ring-like or cylindrical structure by walls 152. Although FIG. 3 shows only a single conduit 142 of the second circular array of heat exchange conduits, it will be understood that each conduit 112 of the first circular array is associated with a corresponding conduit 142 of the second circular array.

Thus, in FIG. 3, a partially thermally-conditioned fluid stream 132 exiting first downstream apertures 126 in sleeves 120 is directed radially outward through second upstream apertures 164, flowing cross-wise into contact with the second array of heat exchange conduits 142, thereby further heating or cooling the process stream to form a fully thermally-conditioned fluid stream 162 which exits the interior region defined by the sleeves 150 through second downstream apertures 166. It will be understood that whereas FIG. 3 illustrates a radially-outward fluid flow path, the same apparatus could be utilized for thermally treating a process stream flowing radially inward to center region 116 and thereafter being axially withdrawn from region 116. In this variation, apertures 166 and 126 would be respectively the first and second upstream apertures, and apertures 164 and 124 would be respectively the first and second downstream apertures.

Figure 4:
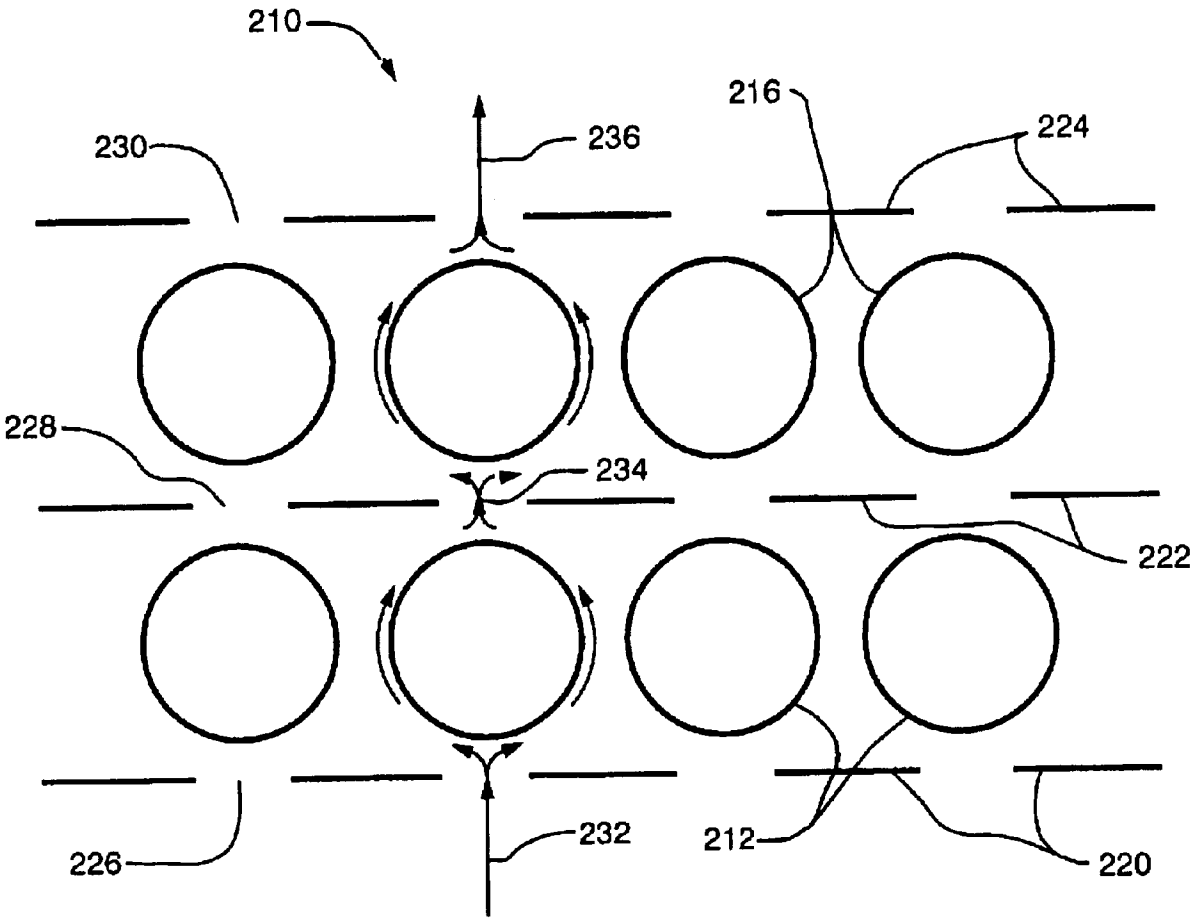
FIG. 4 is a schematic top sectional view of another embodiment of a crossflow heat exchange apparatus, with heat transfer enhancement according to the present invention, showing a double row of axially-disposed heat exchange conduits arranged in a substantially rectangular array with a first, upstream fluid flow-restricted baffle, a second, intermediate fluid flow-restricted baffle separating the first and second rows of conduits, and a third, downstream fluid flow-restricted baffle following the second row of conduits, with the corresponding apertures of the first, second and third baffles shown substantially in alignment with the respective conduits and with each other.

FIG. 4 shows a portion of another crossflow heat exchange apparatus 210 according to this invention. In FIG. 4 a double row of axially-disposed heat exchange conduits, comprising a first upstream row of conduits 212 and second downstream row of conduits 216, are disposed in a generally rectangular array in conjunction with: a first, upstream apertured plate 220 having apertures 226; a second, intermediate apertured plate 222 having apertures 228, plate 222 separating the first and second rows of conduits; and, a third, downstream apertured plate 224 having apertures 230. Each set of apertures 226, 228 and 230 associated with an upstream-downstream adjacent pair of conduits 212 and 216 is shown substantially in linear alignment with each other and with the associated pair of upstream and downstream conduits 212 and 216 respectively.

Thus, in FIG. 4, a process fluid 232 is directed, as denoted by the fluid flow arrows in FIG. 4, through apertures 226 and flowed cross-wise into contact with first, upstream heat exchange conduits 212, thereby partially heating or cooling the process stream to form a partially thermally-conditioned fluid stream 234. Stream 234 is then directed through apertures 228 and flowed cross-wise into contact with second, downstream heat exchange conduits 216 thereby further heating or cooling the process stream to form a fully thermally-conditioned fluid stream 236 which is flowed out of the apparatus 210 through exit apertures 230.

Figure 5:
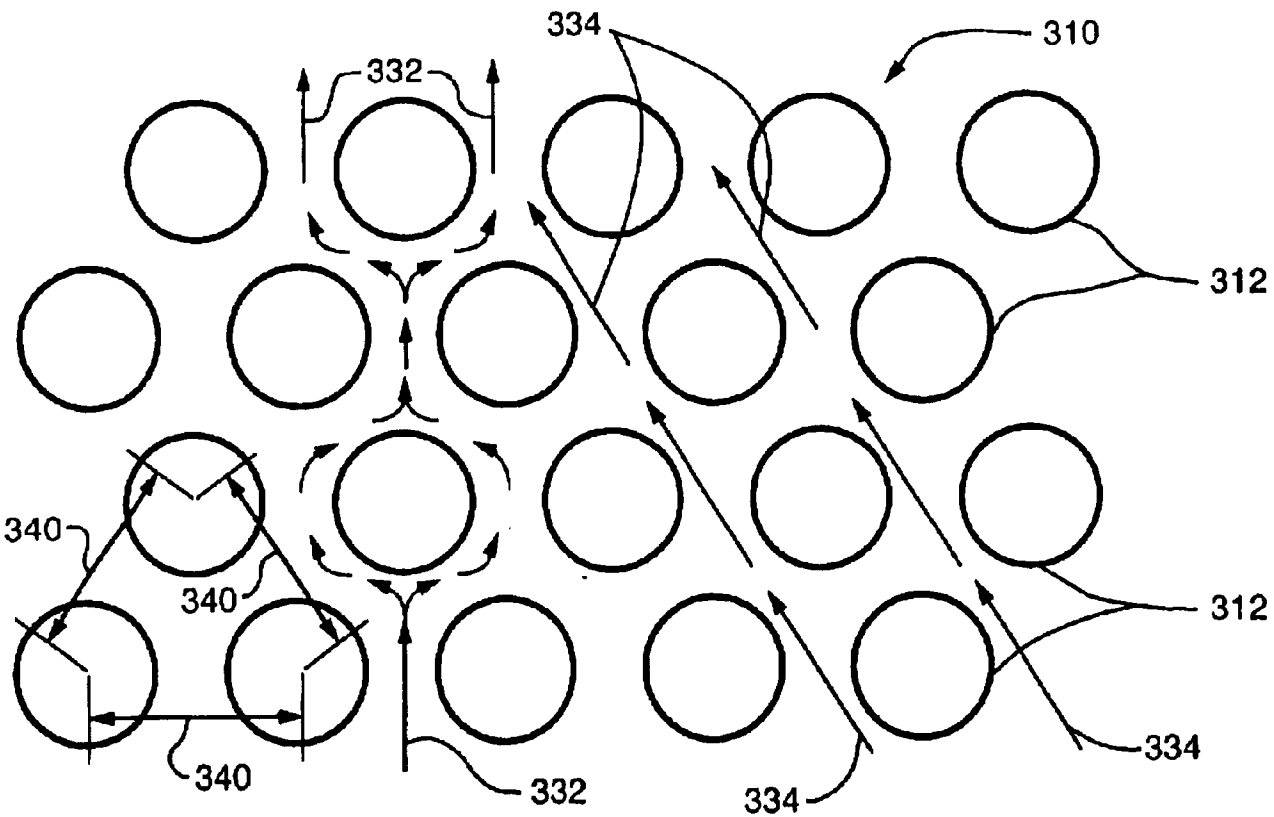
FIG. 5 illustrates still another embodiment of an enhanced crossflow heat transfer apparatus according to this invention showing an array of multiple (i.e., three or more) rows of heat exchange conduits arranged in a triangular pitch and showing two alternative fluid flow paths through the array.
Figure 6:
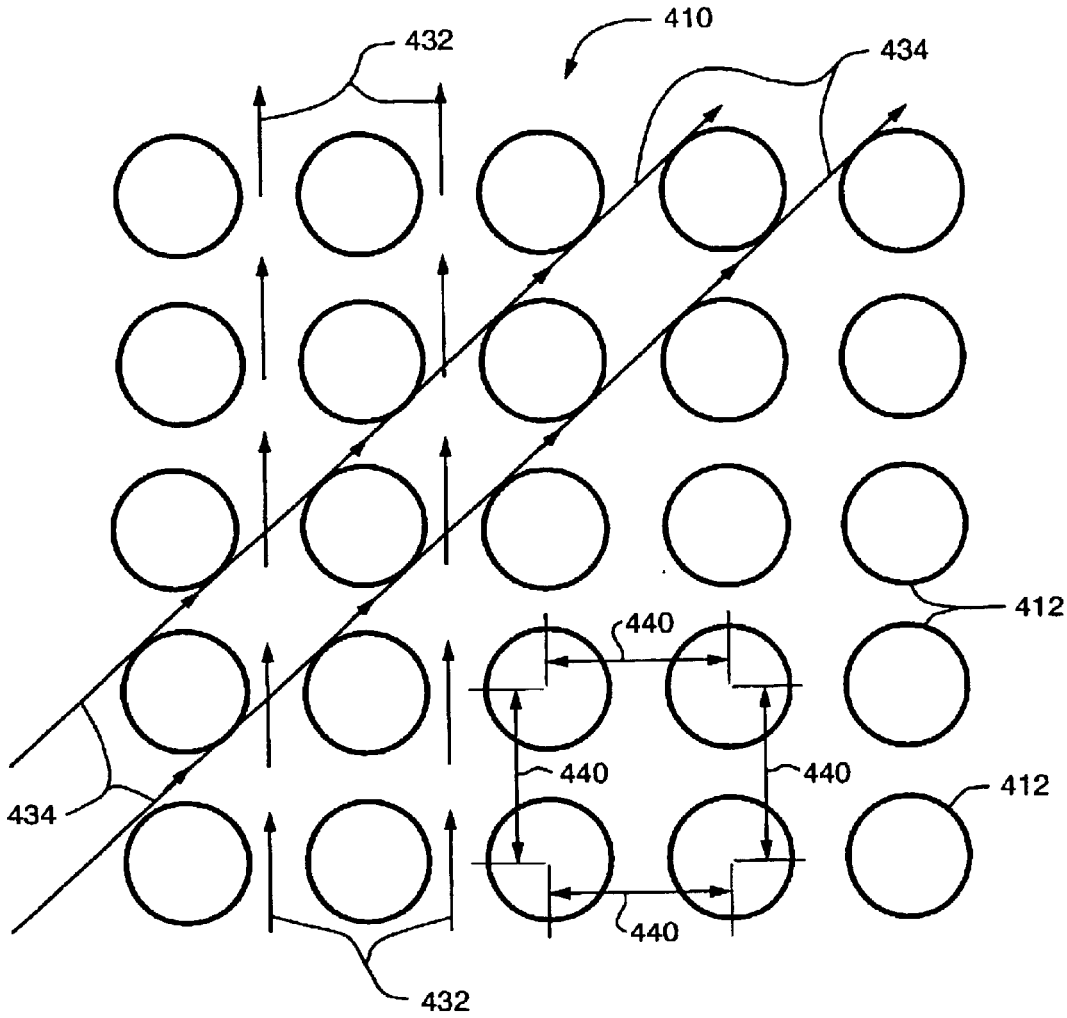
FIG. 6 illustrates another embodiment of an enhanced crossflow heat transfer apparatus according to this invention showing an array of multiple (i.e. three or more) rows of heat exchange conduits arranged in a square pitch and showing two alternative fluid flow paths through the array.

FIG. 5 illustrates two alternative possible fluid flow paths through a multi-row set of heat exchange conduits 312 arranged in an offset or triangular array in accordance with another embodiment of a crossflow heat exchange apparatus 310 according to this invention. Thus, in FIG. 5, alternate rows of heat exchange conduits are offset from adjacent rows instead of having conduits in adjacent rows substantially in linear alignment as shown in FIGS. 4 and 6. In this configuration, the centerpoints of three adjacent conduits in two adjacent rows form an equilateral triangle 340. Although not shown in FIG. 5, it is understood that the apparatus of FIG. 5 includes upstream and downstream apertured plates respectively located before the first row of conduits and after the last row of conduits, as well as intermediate apertured plates separating adjacent rows of conduits. Alternatively each conduit 312 may be surrounded with an apertured sleeve-like structure as previously described for other figures.

Fluid flow arrows 332 in FIG. 5 illustrate a first possible fluid flow orientation which can be utilized with the triangular conduit array of apparatus 310. Fluid flow arrows 334 in FIG. 5 illustrate a second possible fluid flow orientation which can be utilized with the triangular conduit array of apparatus 310. Although FIG. 5 shows four rows of heat exchange conduits in the triangular array, a smaller or larger number of conduit rows in this configuration may be utilized as appropriate.

FIG. 6 illustrates two alternative possible fluid flow paths through a multi-row set of heat exchange conduits 412 arranged in a square array in accordance with still another embodiment of a crossflow heat exchange apparatus 410 according to this invention. Thus, in FIG. 6, conduits 412 in adjacent rows are substantially in linear alignment. In this configuration, the centerpoint of four adjacent conduits in two adjacent rows form a square 440. Although not shown in FIG. 6, it is understood that the apparatus of FIG. 6 includes upstream and downstream apertured plates respectively located before the first row of conduits and after the last row of conduits, as well as intermediate apertured plates separating adjacent rows of conduits. Alternatively, each conduit 412 may be surrounded with an apertured sleeve as previously described.

Fluid flow arrows 432 in FIG.6 illustrate a first possible fluid flow orientation which can be utilized with the square conduit array of apparatus 410. Fluid flow arrows 434 in FIG. 6 illustrate a second possible fluid flow orientation which can be utilized with the square conduit array of apparatus 410. Although FIG. 6 shows five rows of heat exchange conduits in the square array, a smaller or larger number of conduit rows in this configuration may be utilized as appropriate.

Figure 7:
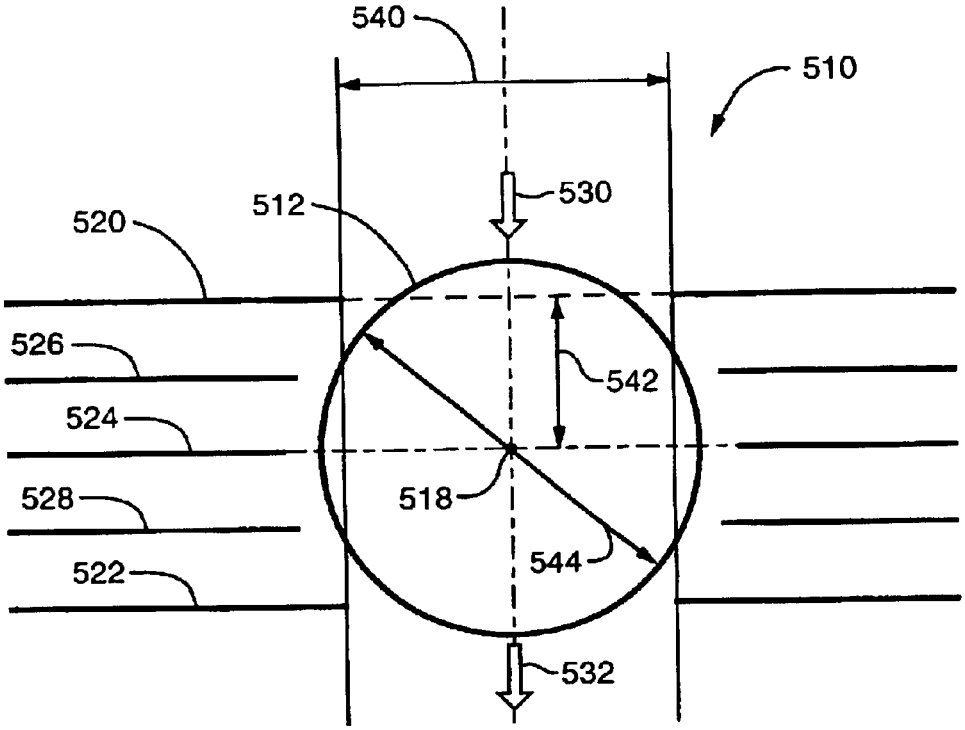
FIG. 7 illustrates still another embodiment of an enhanced crossflow heat transfer apparatus according to this invention showing how one or a plurality of plates can be positioned alongside two sides of each heat exchange conduit to cause preferential contouring of a crossflowing fluid stream to achieve enhanced heat transfer characteristics.

FIG. 7 illustrates still another variation of an enhanced crossflow heat transfer apparatus 510 according to this invention. In FIG. 7, each heat exchange conduit 512 is associated wvith one or more lateral flow-constriction plates 520, 522, 524, 526, and 528 positioned alongside conduit 512 and oriented generally orthogonal to the direction of fluid flow, as indicated by arrows 530 and 532. The edges of the lateral plates 520, 522, 524, 526 and 528 closest to conduit 512 are spaced apart from the exterior walls of conduit 512 so as to create two fluid openings or channels between the plate edges and the conduit wall, one along each side of each conduit 512. The spacing between the plate edges and the conduit wall may be adjusted by routine experimentation to optimize the contouring of the fluid flow path to maximize heat transfer. Where two or more lateral flow-constriction plates are utilized for each conduit 512, the spacing between the plate edges and the conduit wall nay be the same or different in order to optimally contour the fluid flow path.

As seen in FIG. 7, the lateral flow-constriction plates may be positioned alongside conduit 512 such that the plane of the plate passes through the centroid 518 of conduit 512 (such as plate 524), or else be positioned such that the planes of the plates intersect conduit 512 upstream (such as plates 520 and 526) of centroid 518, or downstream (such as plates 522 and 528) of centroid 518, or any combination thereof. The distance 542 between the aperture and the conduit centroid 518 may be less than one-half of the diameter 544 as shown, with a distance approaching zero as a limit, for example plate 524. This differs from the baffle structures shown in FIGS. 1 and 4 where the distance between the apertures and the conduit centroid is greater than one-half the diameter of the conduit. As used herein, the phrase "lateral plate positioned alongside a heat exchange conduit" is meant to refer to plates such as 520, 522, 524, 526 and 528 in FIG. 7, oriented generally orthogonal to the direction of fluid flow, wherein the plane of the plate intersects any part of the heat exchange conduit.

Figure 8:
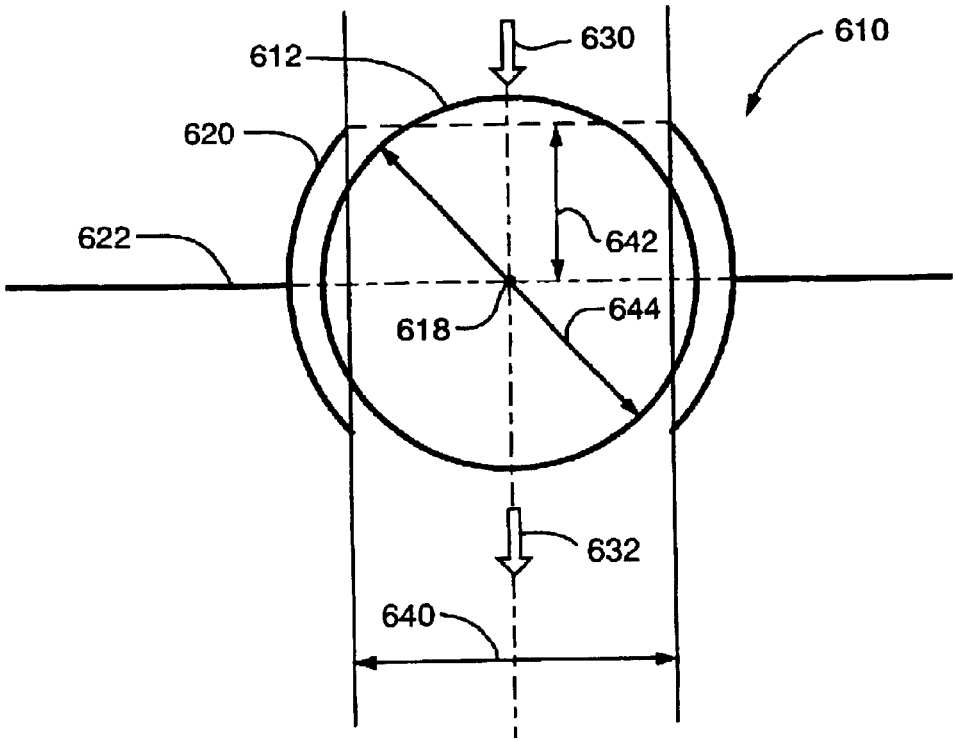
FIG. 8 illustrates yet another embodiment of an enhanced crossflow heat transfer apparatus according to this invention showing an alternative type of sleeve structure formed by positioning curved plates having a contour corresponding to two sides of a conduit around two sides of each heat exchange conduit to cause preferential contouring of a crossflowing fluid stream to achieve enhanced heat transfer characteristics.

FIG. 8 illustrates another variation of an enhanced crossflow heat transfer apparatus 610 according to this invention showing a variation of the apertured sleeve configuration shown in FIG. 2. In FIG. 8, each heat exchange conduit 612 is partially surrounded by a pair of oppositely curved plates 620 generally conforming to the curvature of the outer wall of conduit 612 in a clam-shell configuration. Each curved plate 620 is joined to a wall or lateral plate 622 positioned generally orthogonal to the direction of fluid flow, as indicated by arrows 630 and 632.

The pair of curved plates 620 around either side of a given conduit 612 do not touch each other and do not extend either upstream or downstream of the outer wall of conduit 612. Thus, as shown for illustration purposes in FIG. 8, a line or plane connecting the upstream or downstream edges of a pair of curved plates 620 would intersect conduit 612. The upstream and downstream openings between the pairs of curved plates 620 are the apertures through which the process fluid stream is directed to realize preferential contouring of the fluid stream. The distance 642 between the aperture and the conduit centroid 618 may be less than one-half of the diameter 644 as shown, with a distance approaching zero as a limit, for example, as the lengths of curved plates 620 approach zero leaving only lateral plate 622, a configuration corresponding to FIG. 7 with a single plate 524. This differs from the baffle structures shown in FIGS. 1 and 4 where the distance between the apertures and the conduit centroid is greater than one-half the diameter of the conduit.

The clam-shell configuration of FIG. 8 with each pair of curved plates 620 around the sides of each conduit 612, differs from the slotted sleeve configuration of FIG. 2 in that in FIG. 8 a line or plane connecting the edges of the upstream and downstream fluid openings intersects the conduit 612, which is not the case for the slotted sleeves shown in FIG. 2A. In a sense, the embodiment of FIG. 8 may be viewed as an extreme version of the embodiment of FIG. 7 wherein the individual lateral plates positioned alongside the heat exchange conduit are not spaced apart, as seen in FIG. 7, but instead are positioned face-to-face with one another such that their conduit-side edges form the curved plates 620 of FIG. 8.

It will be apparent to those skilled in the art that other changes and modifications may be made in the above-described apparatus and methods for enhancing crossflow heat transfer without departing from the scope of the invention herein, and it is intended that all matter contained in the above description shall be interpreted in an illustrative and not a limiting sense.

What is claimed is:

1. Fluid flow contouring apparatus for preferentially contouring the fluid path of a process fluid flowing cross-wise across and contacting a plurality of spaced-apart heat transfer conduits, said apparatus comprising a plurality of longitudinally continuous, sleeve-shaped baffle structures, each baffle structure comprising at least a paired set of fluid flow apertures which constitute the only upstream-to-downstream fluid passage through the fluid flow contouring apparatus, each of said baffle structures substantially symmetrically surrounding a heat transfer conduit to define an annular-shaped fluid flow region thereby isolating cross-wise fluid flow around that associated heat transfer conduit from cross-wise fluid flow around adjacent heat transfer conduits located transversely to the direction of fluid flow, and wherein the fluid flow apertures of a baffle structure are symmetrically located respectively upstream and downstream of the associated heat transfer conduit in at least partial upstream and downstream alignment with each other and with the associated heat transfer conduit, whereby each said baffle structure contours the flow path of said process fluid to establish a substantially uniform fluid flow pattern around the contour of the associated heat transfer conduit.

2. Fluid flow contouring apparatus according to claim 1 wherein said heat transfer conduits comprise an array of cylindrical heat transfer conduits oriented to have parallel axes.

3. Fluid flow contouring apparatus according to claim 2 wherein each said baffle structure comprises a sleeve-shaped element which is substantially concentric relative to the associated heat transfer conduit.

4. Fluid flow contouring apparatus according to claim 3 wherein said paired sets of fluid flow apertures comprise upstream and downstream apertures in said sleeve-shaped elements.

5. Fluid flow contouring apparatus according to claim 1 wherein at least two of said baffle structures are interconnected into a larger flow contouring apparatus for contouring fluid flow around a plurality of heat transfer conduits.

6. Fluid flow contouring apparatus according to claim 2 wherein said heat transfer conduits are arranged in a generally circular array.

7. Fluid flow contouring apparatus according to claim 6 wherein the individual baffle structures associated with the heat transfer conduits are interconnected to form a larger, cylindrical-shaped flow contouring apparatus.

8. Fluid flow contouring apparatus according to claim 7 wherein pairs of fluid flow apertures comprise radially-aligned upstream and downstream apertures in the individual baffle structures.

9. Fluid flow contouring apparatus according to claim 7 wherein pairs of fluid flow apertures comprise upstream and downstream apertures in the individual baffle structures which are offset from the radial line.

10. Fluid flow contouring apparatus according to claim 1 wherein said heat transfer conduits comprise at least one generally circular array of axially aligned cylindrical heat transfer conduits, at least some of which are substantially surrounded by a substantially concentric apertured sleeve-shaped structure having upstream and downstream aperture pairs in columns parallel to the axis of the associated conduit, further wherein a sleeve-shaped structure is secured by a plate member to an adjacent sleeve-shaped structure to form a larger cylindrical structure.

11. Fluid flow contouring apparatus according to claim 10 wherein the aperture pairs comprise elongated slots, each slot having a long axis generally parallel to the axes of the heat transfer conduits.

12. Fluid flow contouring apparatus according to claim 11 wherein pairs of elongated slots are in radial alignment.

13. Fluid flow contouring apparatus according to claim 11 wherein a heat transfer conduit is associated with two pairs of elongated slots, each slot pair being offset from radial alignment with the axis of the larger cylindrical structure.

14. Fluid flow contouring apparatus according to claim 13 wherein the two upstream and the two downstream elongated slots associated with each heat transfer conduit are axially offset from one another but axially aligned with the opposite pair member.

15. Fluid flow contouring apparatus according to claim 10 wherein said heat transfer conduits comprise at least two generally circular arrays of cylindrical heat transfer conduits oriented to have parallel axes, one array being concentric relative to the other.

16. Fluid flow contouring apparatus according to claim 15 wherein the aperture pairs comprise elongated slots in radial alignment, each slot having a long axis generally parallel to the axes of the heat transfer conduits.

17. Fluid flow contouring apparatus according to claim 15 wherein the baffle structures of adjacent pairs of radially-aligned heat transfer conduits are interconnected such that an aperture between the baffle structures serves as the downstream fluid flow aperture for one of the conduits and the upstream fluid flow aperture for the other.

18. Fluid flow contouring apparatus according to claim 17 wherein the aperture pairs comprise elongated slots in radial alignment, each slot having a long axis generally parallel to the axes of the heat transfer conduits.

19. Fluid flow contouring apparatus for preferentially contouring the fluid path of a process fluid flowing cross-wise across and contacting a plurality of spaced-apart heat transfer conduits, said apparatus comprising a plurality of longitudinally continuous, sleeve-shaped baffle structures, each baffle structure comprising at least a paired set of fluid flow apertures which constitute the only upstream-to-downstream fluid passage through the fluid flow contouring apparatus, each of said baffle structures substantially symmetrically surrounding a heat transfer conduit to define an annular-shaped fluid flow region thereby isolating cross-wise fluid flow around that associated heat transfer conduit from cross-wise fluid flow around adjacent heat transfer conduits located transversely to the direction of fluid flow, and wherein the fluid flow apertures of a baffle structure are symmetrically located respectively upstream and downstream of the associated heat transfer conduit in at least partial upstream and downstream alignment with each other and with the associated heat transfer conduit, whereby each said baffle structure contours the flow path of said process fluid to establish a substantially uniform fluid flow pattern around the contour of the associated heat transfer conduit, further wherein said heat transfer conduits comprise a substantially rectangular array comprising at least three axially aligned rows of cylindrical heat transfer conduits oriented to have parallel axes, and wherein the associated baffle structures comprise generally concentric sleeve-shaped elements having upstream and downstream aperture pairs.

20. Fluid flow contouring apparatus for preferentially contouring the fluid path of a process fluid flowing cross-wise across and contacting a plurality of spaced-apart heat transfer conduits, said apparatus comprising a plurality of longitudinally continuous, sleeve-shaped baffle structures, each baffle structure comprising at least a paired set of fluid flow apertures which constitute the only upstream-to-downstream fluid passage through the fluid flow contouring apparatus, each of said baffle structures substantially symmetrically surrounding a heat transfer conduit to define an annular-shaped fluid flow region thereby isolating cross-wise fluid flow around that associated heat transfer conduit from cross-wise fluid flow around adjacent heat transfer conduits located transversely to the direction of fluid flow, and wherein the fluid flow apertures of a baffle structure are symmetrically located respectively upstream and downstream of the associated heat transfer conduit in at least partial upstream and downstream alignment with each other and with the associated heat transfer conduit, whereby each said baffle structure contours the flow path of said process fluid to establish a substantially uniform fluid flow pattern around the contour of the associated heat transfer conduit, further wherein said heat transfer conduits comprise a substantially rectangular array comprising at least three rows of cylindrical heat transfer conduits, with alternate rows being axially offset from adjacent upstream and downstream rows, the heat transfer conduits oriented to have parallel axes, and wherein the associated baffle structures comprise generally concentric sleeve-shaped elements having upstream and downstream aperture pairs.

21. Fluid flow contouring apparatus according to claim 1 wherein the baffle structure associated with a heat transfer conduit comprises contoured plate members positioned in pairs alongside two sides of the heat transfer conduit in proximity to without touching the surface of the conduit, said plate members having a contour corresponding respectively to the two sides of the heat transfer conduit so as to define generally annular-shaped fluid flow regions having upstream and downstream openings around said heat transfer conduits, said plate members being joined to other plate members associated with adjacent heat transfer conduits.

22. A method for enhancing heat transfer to or from a fluid flowing cross-wise in contact with the outer surfaces of a plurality of heat exchange conduits comprising the step of preferentially contouring cross-wise fluid flow across the heat exchange conduits by flowing the fluid through at least a paired set of fluid flow constrictors in a longitudinally continuous, sleeve-shaped baffle structure associated with a heat exchange conduit, said baffle structure being part of an array of such baffle structures, each of which substantially symmetrically surrounds its associated heat exchange conduit to isolate cross-wise fluid flow around that associated heat exchange conduit from cross-wise fluid flow around adjacent heat exchange conduits located transversely to the direction of fluid flow, wherein the fluid flow constrictors of each baffle structure constitute the only upstream-to-downstream fluid passage through the baffle structure array and are symmetrically located respectively upstream and downstream of the associated heat exchange surface in at least partial upstream and downstream alignment with each other and with the associated heat exchange conduit, and whereby each baffle structure contours the flow path of said fluid to establish a substantially uniform fluid flow pattern around the contour of the associated heat exchange conduit.

23. A method according to claim 22 wherein said heat exchange conduits comprise an array of cylindrical heat exchange conduits oriented to have parallel axes.

24. A method according to claim 23 wherein each said baffle structure comprises a sleeve-shaped element which is substantially concentric relative to the associated heat exchange conduit.

25. A method according to claim 24 wherein said paired sets of fluid flow constrictors comprise upstream and downstream apertures in said sleeve-shaped elements.

26. A method according to claim 22 wherein at least two of said baffle structures are interconnected into a larger flow contouring apparatus for contouring fluid flow around a plurality of heat exchange conduits.

27. A method according to claim 24 wherein said heat exchange conduits are arranged in a generally circular array.

28. A method according to claim 27 wherein the individual baffle structures associated with the heat exchange conduits are interconnected to form a larger, cylindrical-shaped flow contouring apparatus.

29. A method according to claim 28 wherein pairs of fluid flow constrictors comprise radially-aligned upstream and downstream apertures in the individual baffle structures.

30. A method according to claim 28 wherein pairs of fluid flow constrictors comprise upstream and downstream apertures in the individual baffle structures which are offset from the radial line.

31. A method according to claim 22 wherein said heat exchange conduits comprise at least one generally circular array of axially aligned cylindrical heat exchange conduits, at least some of which are substantially surrounded by a substantially concentric apertured sleeve-shaped structure having upstream and downstream aperture pairs in columns parallel to the axis of the associated conduit, further wherein a sleeve-shaped structure is secured by a plate member to an adjacent sleeve-shaped structure to form a larger cylindrical structure.

32. A method according to claim 31 wherein the aperture pairs comprise elongated slots, each slot having a long axis generally parallel to the axes of the heat exchange conduits.

33. A method according to claim 32 wherein pairs of elongated slots are in radial alignment.

34. A method according to claim 32 wherein a heat exchange conduit is associated with two pairs of elongated slots, each slot pair being offset from radial alignment with the axis of the larger cylindrical structure.

35. A method according to claim 34 wherein the two upstream and the two downstream elongated slots associated with each heat exchange conduit are axially offset from one another but axially aligned with the opposite pair member.

36. A method according to claim 31 wherein said heat exchange conduits comprise at least two generally circular arrays of cylindrical heat exchange conduits oriented to have parallel axes, one array being concentric relative to the other.

37. A method according to claim 36 wherein the aperture pairs comprise elongated slots in radial alignment, each slot having a long axis generally parallel to the axes of the heat exchange conduits.

38. A method according to claim 36 wherein the baffle structures of adjacent pairs of radially-aligned heat exchange conduits are interconnected such that an aperture between the baffle structures serves as the downstream fluid flow constrictor for one of the conduits and the upstream fluid flow constrictor for the other.

39. A method according to claim 38 wherein the aperture pairs comprise elongated slots in radial alignment, each slot having a long axis generally parallel to the axes of the heat exchange conduits.

40. A method for enhancing heat transfer to or from a fluid flowing cross-wise in contact with the outer surfaces of a plurality of heat exchange conduits comprising the step of preferentially contouring cross-wise fluid flow across the heat exchange conduits by flowing the fluid through at least a paired set of fluid flow constrictors in a longitudinally continuous, sleeve-shaped baffle structure associated with a heat exchange conduit, said baffle structure being part of an array of such baffle structures, each of which substantially symmetrically surrounds its associated heat exchange conduit to isolate cross-wise fluid flow around that associated heat exchange conduit from cross-wise fluid flow around adjacent heat exchange conduits located transversely to the direction of fluid flow, wherein the fluid flow constrictors of each baffle structure constitute the only upstream-to-downstream fluid passage through the baffle structure array and are symmetrically located respectively upstream and downstream of the associated heat exchange surface in at least partial upstream and downstream alignment with each other and with the associated heat exchange conduit, and whereby each baffle structure contours the flow path of said fluid to establish a substantially uniform fluid flow pattern around the contour of the associated heat exchange conduit, further wherein said heat exchange conduits comprise a substantially rectangular array comprising at least three axially aligned rows of cylindrical heat exchange conduits oriented to have parallel axes, and wherein the associated baffle structures comprise generally concentric sleeve-shaped elements having upstream and downstream aperture pairs.

41. A method for enhancing heat transfer to or from a fluid flowing cross-wise in contact with the outer surfaces of a plurality of heat exchange conduits comprising the step of preferentially contouring cross-wise fluid flow across the heat exchange conduits by flowing the fluid through at least a paired set of fluid flow constrictors in a longitudinally continuous, sleeve-shaped baffle structure associated with a heat exchange conduit, said baffle structure being part of an array of such baffle structures, each of which substantially symmetrically surrounds its associated heat exchange conduit to isolate cross-wise fluid flow around that associated heat exchange conduit from cross-wise fluid flow around adjacent heat exchange conduits located transversely to the direction of fluid flow, wherein the fluid flow constrictors of each baffle structure constitute the only upstream-to-downstream fluid passage through the baffle structure array and are symmetrically located respectively upstream and downstream of the associated heat exchange surface in at least partial upstream and downstream alignment with each other and with the associated heat exchange conduit, and whereby each baffle structure contours the flow path of said fluid to establish a substantially uniform fluid flow pattern around the contour of the associated heat exchange conduit, and wherein said heat exchange conduits comprise an array of cylindrical heat exchange conduits oriented to have parallel axes and which comprises a substantially rectangular array comprising at least three rows of cylindrical heat exchange conduits, with alternate rows being axially offset from adjacent upstream and downstream rows, the heat exchange conduits oriented to have parallel axes, and wherein the associated baffle structures comprise generally concentric sleeve-shaped elements having upstream and downstream aperture pairs.

42. A method according to claim 22 wherein the baffle structure associated with a heat exchange conduit comprises contoured plate members positioned in pairs alongside two sides of the heat exchange conduit in proximity to without touching the surface, said plate members having a contour corresponding respectively to the two sides of the heat exchange conduit so as to define generally annular-shaped fluid flow regions having upstream and downstream openings around said heat exchange conduits, said plate members being joined to other plate members associated with adjacent heat exchange conduits.

* * * * *